US009321610B2

(12) United States Patent
Fargo et al.

(10) Patent No.: US 9,321,610 B2
(45) Date of Patent: Apr. 26, 2016

(54) FRICTIONAL DAMPER FOR REDUCING ELEVATOR CAR MOVEMENT

(75) Inventors: Richard N. Fargo, Plainville, CT (US); Daniel S. Young, Bloomington, IN (US); Jason K. Romain, Ellettsville, IN (US); Harold Terry, Avon, CT (US); Randall Keith Roberts, Hebron, CT (US); Leandre Adifon, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 175 days.

(21) Appl. No.: 13/995,506

(22) PCT Filed: Dec. 22, 2010

(86) PCT No.: PCT/US2010/061809

§ 371 (c)(1),
(2), (4) Date: Jun. 19, 2013

(87) PCT Pub. No.: WO2012/087312

PCT Pub. Date: Jun. 28, 2012

(65) Prior Publication Data

US 2013/0277152 A1 Oct. 24, 2013

(51) Int. Cl.

| | |
|---|---|
| ***B66B 5/18*** | (2006.01) |
| ***B66B 7/04*** | (2006.01) |
| ***B66D 5/30*** | (2006.01) |
| ***B66B 5/00*** | (2006.01) |

(52) U.S. Cl.
CPC ... *B66B 5/00* (2013.01); *B66B 5/18* (2013.01); *B66B 7/041* (2013.01); *B66D 5/30* (2013.01)

(58) Field of Classification Search
CPC ..... B66B 5/16; B66B 5/18; B66D 5/30; B66D 2700/0141
See application file for complete search history.

(56) References Cited

U.S. PATENT DOCUMENTS 802,074 A * 10/1905 Dillon ..... 192/141
2,663,387 A * 12/1953 Berkovitz ..... 188/171

(Continued)

FOREIGN PATENT DOCUMENTS

CN 1279208 A 1/2001
JP 2004210423 A 7/2004

(Continued)

OTHER PUBLICATIONS

International Search Report and Written Opinion for International application No. PCT/US2010/061809 dated Sep. 20, 2011.

(Continued)

*Primary Examiner* — William E Dondero
*Assistant Examiner* — Minh Truong
(74) *Attorney, Agent, or Firm* — Carlson, Gaskey & Olds

(57) ABSTRACT

An exemplary device for use in an elevator system includes at least one friction member that is selectively moveable into a damping position in which the friction member is useful to damp movement of an elevator car associated with the device. A solenoid actuator has an armature that is situated for vertical movement. The armature moves upward when the solenoid is energized to move the friction member into the damping position. The armature mass urges the armature in a downward vertical direction causing the friction member to move out of the damping position when the solenoid is not energized.

19 Claims, 4 Drawing Sheets

(56) References Cited

U.S. PATENT DOCUMENTS

| | | | | |
|---|---|---|---|---|
| 4,896,127 | A * | 1/1990 | Hida | 335/239 |
| 5,014,828 | A * | 5/1991 | Baldassarre | 188/173 |
| 5,101,939 | A * | 4/1992 | Sheridan | 188/171 |
| 5,234,079 | A * | 8/1993 | Nomura | 187/250 |
| 5,244,060 | A * | 9/1993 | Tanaka et al. | 187/261 |
| 5,265,701 | A * | 11/1993 | Ogasawara et al. | 187/254 |
| 5,402,863 | A * | 4/1995 | Okumura et al. | 187/288 |
| 5,663,700 | A | 9/1997 | Spence et al. | |
| 6,193,026 | B1 | 2/2001 | Sevilleja et al. | |
| 6,318,505 | B1 | 11/2001 | De Angelis | |
| 6,778,049 | B1 * | 8/2004 | Alyanak | 335/255 |
| 7,267,201 | B2 | 9/2007 | Ito | |
| 7,849,972 | B2 | 12/2010 | Higashinaka | |
| 8,205,446 | B2 * | 6/2012 | Xie | 60/545 |
| 2007/0272503 | A1 * | 11/2007 | Kigawa et al. | 188/156 |
| 2010/0259095 | A1 * | 10/2010 | Xie | 303/3 |

FOREIGN PATENT DOCUMENTS

| | | | |
|---|---|---|---|
| JP | 2004250178 | A | 9/2004 |
| JP | 2010013213 | A | 1/2010 |

OTHER PUBLICATIONS

Chinese Search Report for Application No. 2010800708528 dated Sep. 2, 2014.

International Preliminary Report on Patentability for International application No. PCT/US2010/061809 dated Jul. 4, 2013.

* cited by examiner

FRICTIONAL DAMPER FOR REDUCING ELEVATOR CAR MOVEMENT

BACKGROUND

Elevator systems include a machine for moving the elevator car to provide elevator service. In traction-based systems a roping arrangement suspends the weight of the elevator car and a counterweight. Traction between the roping arrangement and a traction sheave that is moved by the elevator machine provides the ability to move the elevator car as desired.

When the rise of an elevator system is sufficiently large, the longer roping members introduce the possibility for an elevator car to bounce or oscillate as a result of a change in load while the elevator car is at a landing. In some cases, elevator passengers may perceive a bounciness of the elevator car, which is undesirable.

There are various known devices for holding an elevator car fixed at a landing. Mechanical stops have been introduced into elevator systems to engage a stationary structure to hold the elevator car rigidly in place. Brake devices have been proposed that engage a guide rail or other stationary structure within the hoistway to prevent movement of the elevator car. Such devices may however require additional maintenance and service when a brake or mechanical stop does not release from a locked position when necessary. Additionally, many such devices introduce noise. There is a need for an improved way of stabilizing an elevator car when it is stopped.

SUMMARY

An exemplary device for use in an elevator system includes at least one friction member that is selectively moveable into a damping position in which the friction member is useful to damp movement of an elevator car associated with the device. A solenoid actuator has an armature that is situated for vertical movement. The armature moves upward when the solenoid is energized to move the friction member into the damping position. The armature mass urges the armature in a downward vertical direction causing the friction member to move out of the damping position when the solenoid is not energized.

An exemplary elevator system includes an elevator car. A plurality of load bearing members suspends the elevator car. At least one guide rail is situated to guide vertical movement of the elevator car. A damping device is supported on the elevator car. The damping device includes at least one friction member that is selectively moveable into a damping position in which the friction member engages the guide rail to damp movement of the elevator car. A solenoid actuator has an armature that is situated for vertical movement. The armature moves upward when the solenoid is energized to move the friction member into the damping position. The armature mass urges the armature in a downward vertical direction causing the friction member to move out of the damping position when the solenoid is not energized.

An exemplary method of controlling the position of an elevator car includes stopping the elevator car in a desired position. Energizing a solenoid causes upward movement of an armature of the solenoid which causes a friction member to move into a damping position in which the friction member engages a guide rail associated with the elevator car. Deenergizing the solenoid allows gravity to urge the armature downward and the friction member out of the damping position before moving the elevator car from the desired position.

The various features and advantages of a disclosed example will become apparent to those skilled in the art from the following detailed description. The drawings that accompany the detailed description can be briefly described as follows.

DETAILED DESCRIPTION

Figure 1:
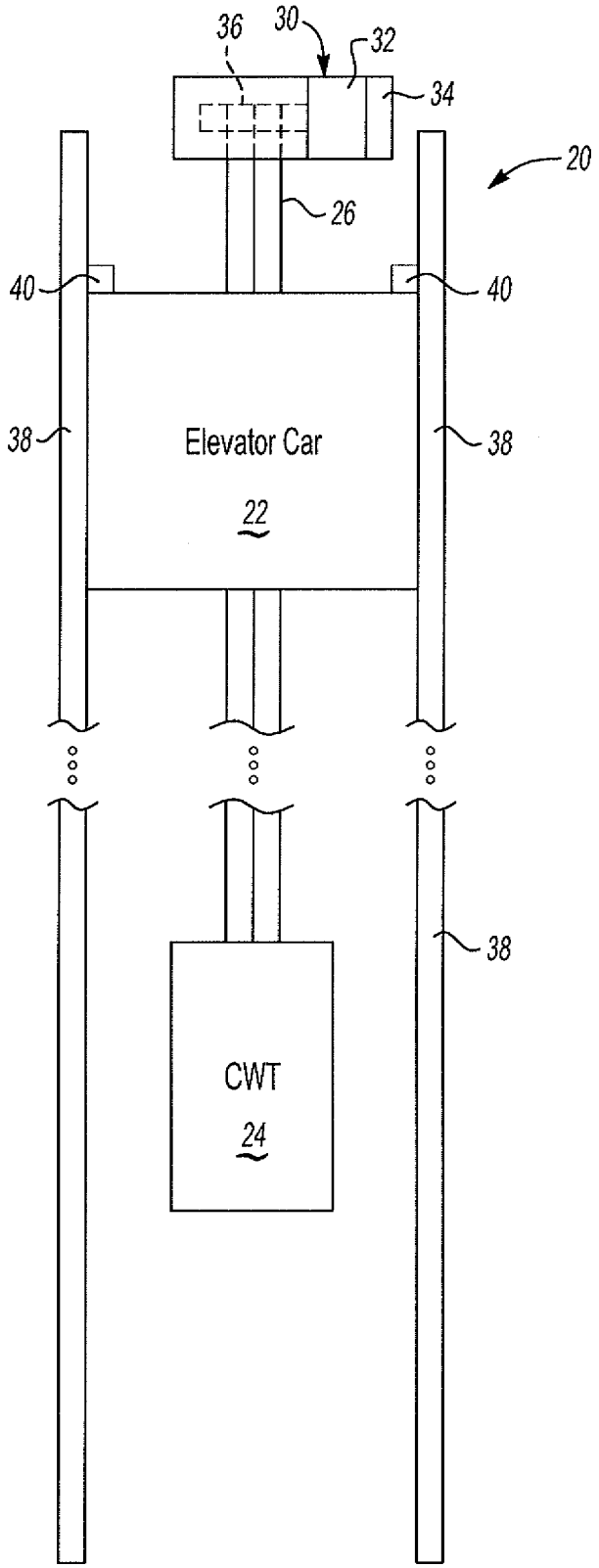
FIG. 1 schematically illustrates selected portions of an example elevator system including a damping device designed according to an embodiment of this invention.

FIG. 1 schematically shows selected portions of an example elevator system 20. An elevator car 22 is coupled with a counterweight 24. A plurality of load bearing members 26 are used as a roping arrangement for suspending the load of the elevator car 22 and the counterweight 24. In one example, the load bearing members 26 comprise flat belts.

An elevator machine 30 includes a motor 32 and a brake 34 to control movement of a traction sheave 36. Traction between the load bearing members 26 and the traction sheave 36 provides control over the movement and position of the elevator car 22. For example, the motor 32 causes the traction sheave 36 to rotate which causes movement of the load bearing members 26 to achieve a desired movement of the elevator car 22 along guide rails 38.

The brake 34 is used to prevent rotation of the traction sheave 36 for stopping the elevator car 22 at a desired vertical position along the guide rails 38. In one example, the load bearing members 26 have a construction and a length that introduces the possibility for the elevator car 22 to bounce or oscillate vertically relative to a desired parking position. The example of FIG. 1 includes damping devices 40 supported on the elevator car 22. The damping devices 40 in this example frictionally engage the guide rails 38 to damp any bouncing or oscillating movement of the elevator car 22 when it is stopped at a desired parking position.

Figure 2:
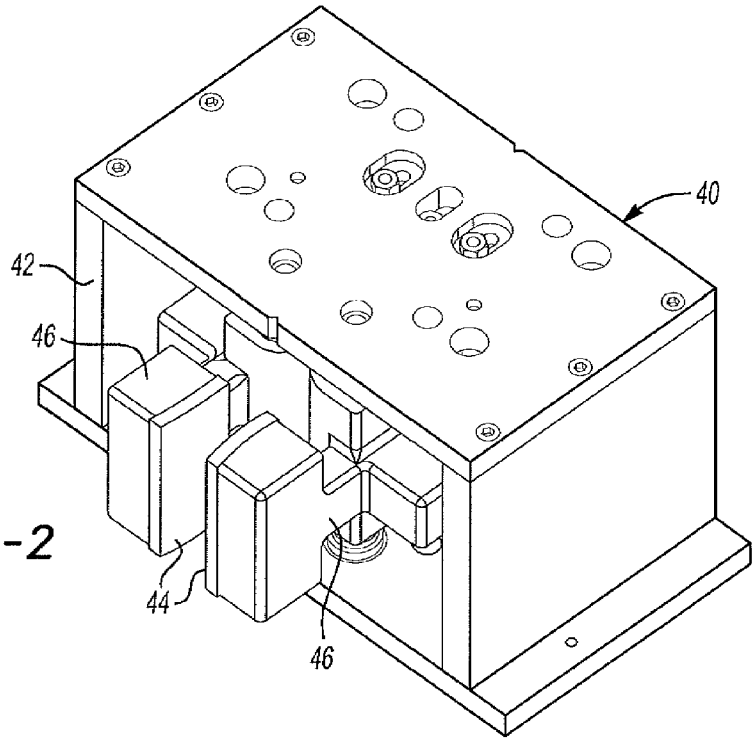
FIG. 2 diagrammatically illustrates an example damping device designed according to an embodiment of this invention.

FIG. 2 shows one example damping device 40. This example includes a housing 42 that can be secured to a selected portion of the elevator car 22. The damping device 40 includes friction members 44 such as brake pad lining material supported near ends of arms 46, which are supported by the housing 42. The arms 46 are at least partially moveable relative to the housing 42 so that the friction members 44 may frictionally engage a stationary surface within the hoistway such as a surface on the guide rail 38.

Figure 3:
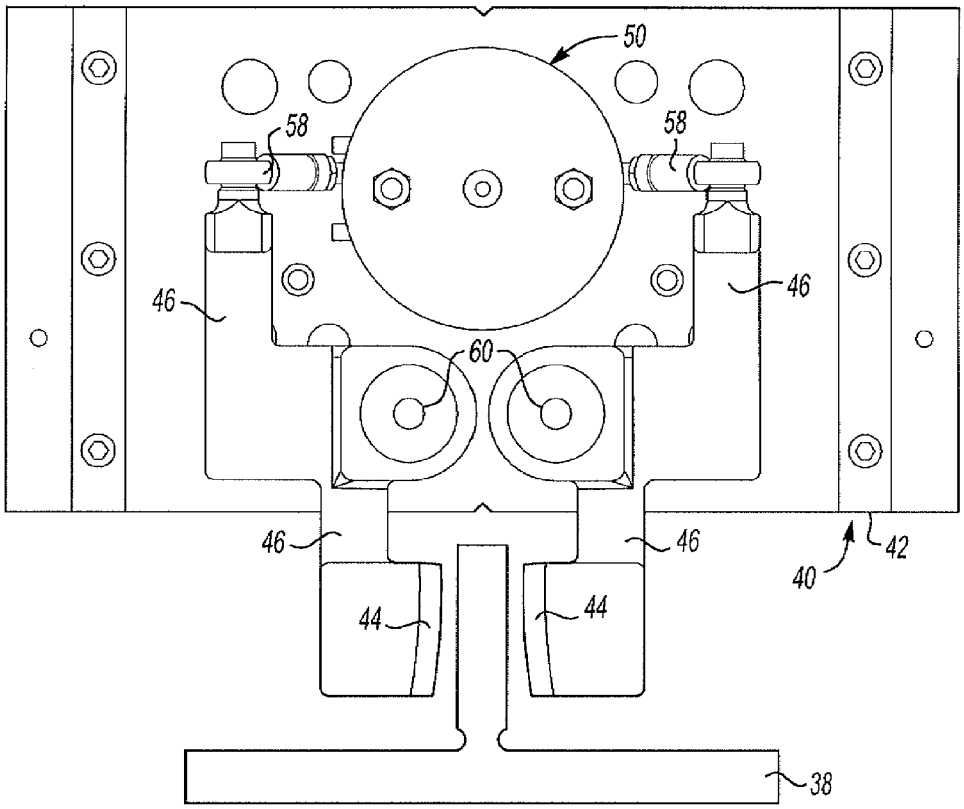
FIG. 3 is an elevational view of the example of FIG. 2 as viewed from the top.
Figure 4:
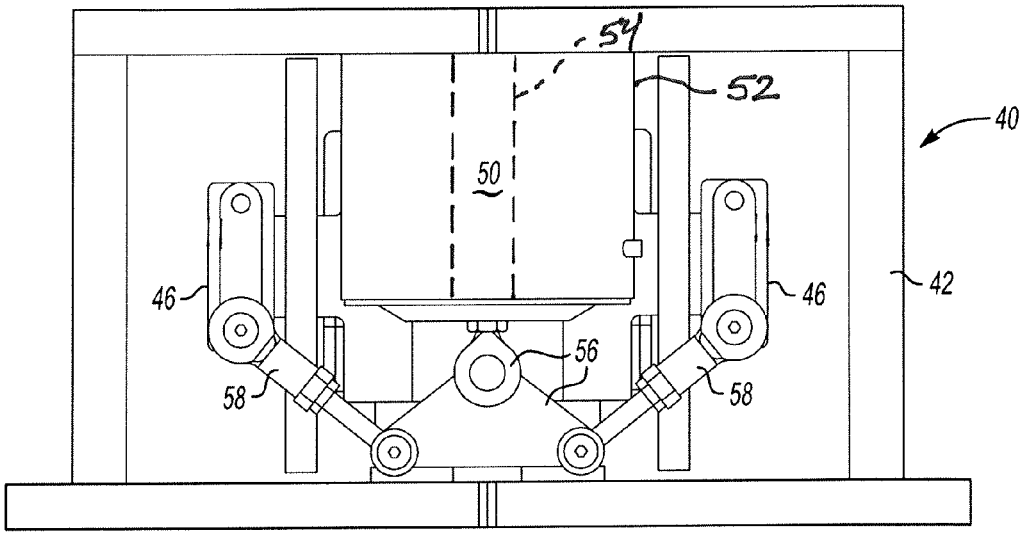
FIG. 4 is an elevational view of the example of FIG. 2 as viewed from a side.

The example damping device 40 includes a unique arrangement of components that provides for smooth, quiet and reliable operation of the damping device 40. FIGS. 3 and 4 show a solenoid 50 that is selectively energized for causing movement of the friction members 44 into a damping position to control vertical motion of the elevator car when it is stopped at a landing. In one example, the solenoid 50 is energized responsive to opening of doors on the elevator car 22. In another example, the solenoid 50 is energized responsive to an indication that the elevator car 22 is stopped in a desired parking position. The solenoid 50 includes a housing 52 that is supported within the damping device housing 42 so that it remains stationary or fixed relative to the housing 42, which remains fixed relative to the structure of the elevator car 22.

The solenoid housing 52 is situated so that an armature 54 (shown in FIGS. 4 and 5) of the solenoid 50 moves vertically when the damping device 40 is supported on the elevator car 22. Vertical movement of the armature 54 causes desired movement of the friction members 44. In this example, as best appreciated in FIG. 4, a connector 56 couples the armature 54 to links 58 that are coupled with the arms 46. As best appreciated in FIG. 3, as the links 58 are forced in a generally outward direction relative to the solenoid housing 52 as the armature 54 moves upward, the arms 46 pivot about pivot points 60. Such movement causes the friction members 44 to move horizontally and inward toward a surface 64 on the guide rail 38.

In one example, the damping position in which the friction members 44 engage the surface 64 introduces enough friction to damp bouncing or oscillation of the elevator car 22. The level of engagement between the friction members 44 and the surface 64, however, is not sufficient to be a braking or holding force that holds the elevator car 22 rigidly in position relative to the guide rails 38. This example includes introducing only a sufficient friction force for damping undesired movement of the elevator car 22.

One feature of the example links 58 and connector 56 is that different lengths or masses for those components provide a different movement of the arms 46. The size of the connector 56 and links 58 may be selected to provide a desired mechanical advantage so that the force associated with frictionally engaging the guide rail 38 by the friction members 44 has a desired magnitude given the operating characteristics of the selected solenoid 50. Given this description, those skilled in the art will realize how to configure the linkage arrangement between the solenoid armature and the arms 46 to meet the needs of their particular situation.

When it is necessary to move the elevator car again, the solenoid 50 is deenergized. The mass of the armature 54 is urged downward (see FIG. 4) by gravity. Downward movement of the armature 54 causes the arms 46 to pivot about the pivot points 60 (FIG. 3) in a direction opposite the arrows 62, which moves the friction members 44 away from the surface 64 of the guide rail 38, so that they are no longer in the damping position. In this example, the mass of the connector 56 contributes to the effect of gravity on the vertical position of the armature 54 by providing additional mass for urging the armature 54 downward, which urges the friction members 44 out of the damping position.

The illustrated example includes utilizing a vertically oriented solenoid armature and gravity for resetting the damping device 40 into a non-engagement position. This provides more reliable operation compared to devices in which a solenoid is positioned so that the armature moves horizontally to introduce a braking force to prevent movement of an elevator car, for example. The vertically oriented solenoid of this example ensures that the damping device 40 will not interfere with desired movement of the elevator car 22 whenever the solenoid is deenergized. Additionally, relying upon gravity for resetting the damping device 40 overcomes any binding effect that may result from engagement between the friction members 44 and the surface 64 on the guide rail 38.

Another feature of the illustrated example can be appreciated from FIG. 3. The friction members 44 have a curved profile. This configuration ensures reliable contact between the friction members 44 and the surface 64. The curved profile of friction members 44 avoids point contact even if there is some misalignment between the damping device 40 and the guide rail 38. This further ensures more reliable operation of the damping device.

Figure 5:
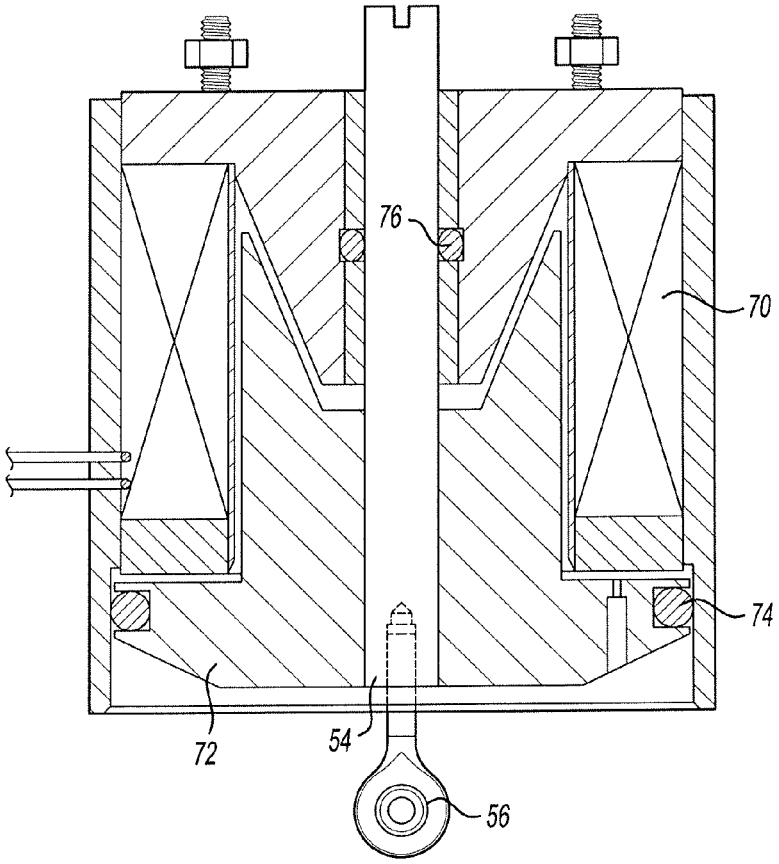
FIG. 5 is a cross-sectional illustration showing selected features of an example solenoid used in one example embodiment.

Another feature of the illustrated example is that the solenoid 50 is configured to provide quiet operation. In one example, the solenoid 50 has a noise reducing feature to reduce or eliminate noise associated with movement of the armature 54 during energization or deenergization of the solenoid 50. FIG. 5 illustrates one example arrangement of an example solenoid 50. A coil 70 is supported within the housing 52. When the coil 70 is energized, a plunger 72 and the rod of the armature 54 moves upward relative to the housing 52. A noise reducing member 74 is associated with the plunger 72. This example includes another noise reducing member 76 associated with the rod 54. The noise reducing members 74 and 76 in this example comprise O-rings.

The noise reducing members 74 and 76 establish air cushions within the housing 52 so that movement of the armature (e.g., plunger 72 and rod 54) is pneumatically damped. This reduces or eliminates noise associated with such movement and provides quiet damping device operation.

Figure 6:
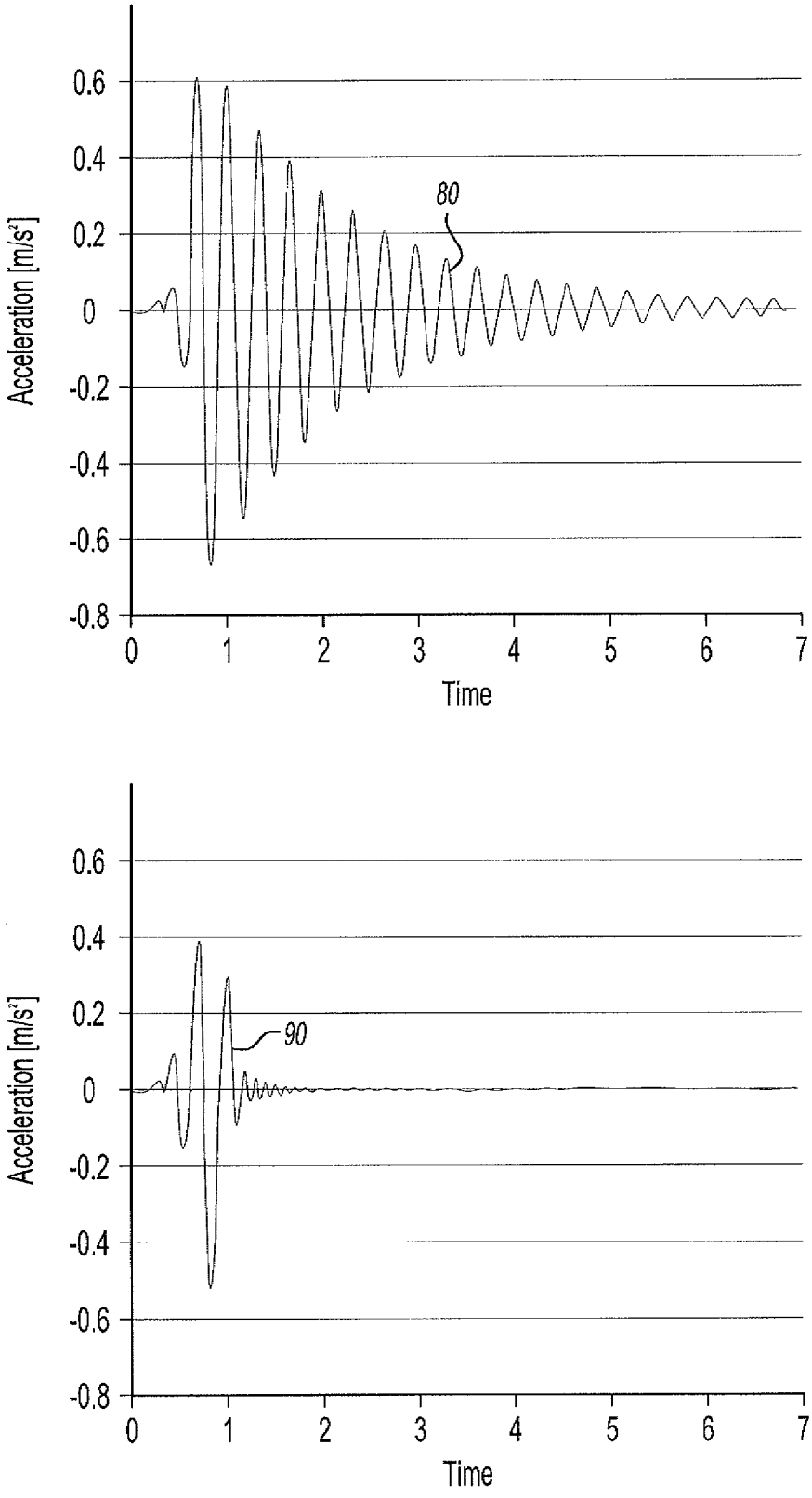
FIG. 6 illustrates damping effects with an example embodiment.

FIG. 6 illustrates performance of an example embodiment. A first plot 80 shows elevator car oscillations resulting from a change in load while the elevator car is stopped at a landing. As can be appreciated from the drawing, oscillations of significant magnitude continue for more than five seconds.

A second plot 90 shows the oscillations resulting from the same change in load at the same landing with a damper device 40 energized. The oscillations are significantly damped and essentially eliminated in about one second. Additionally, the damped condition prevents further changes in load from introducing further oscillations. During the oscillations at 80, an additional change in load or introduced acceleration on the car will contribute to the oscillations and cause them to increase in magnitude. Accordingly, the disclosed damper device 40 significantly improves car stability.

Another feature of the illustrated example is that it provides a fast response time for activating or deactivating the damping device 40. Transitions between an engaged or disengaged position can be completed quickly in a manner that does not introduce any noticeable delays into the elevator system operation. The illustrated example allows for maximizing speed and minimizing noise because it provides a low-noise damping device that does not interfere with passenger satisfaction with elevator service.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car;

a plurality of ropes suspending the elevator car;

at least one guide rail situated to guide vertical movement of the elevator car; and a damping device supported on the elevator car, the damping device including at least one friction member that is selectively moveable into a damping position in which the friction member engages the guide rail to damp movement of the elevator car and a solenoid actuator having an armature that is situated for vertical movement, the armature moving upward when the solenoid is energized to move the friction member into the damping position, a mass of the armature urging the armature in a downward vertical direction causing the friction member to move out of the damping position when the solenoid is not energized.

2. The elevator system of claim 1, wherein the vertical movement of the armature is translated into horizontal movement of the friction member.

3. The elevator system of claim 2, wherein the damping device comprises an arm that supports the friction member near one end of the arm; and a linkage coupling the armature to the arm, a mass of the linkage urging the armature downward when the solenoid is not energized.

4. The elevator system of claim 1, comprising two friction members that move toward each other when moving into the damping position.

5. The elevator system of claim 1, wherein the solenoid comprises a noise reducing member that reduces noise associated with movement of the armature.

6. The elevator system of claim 5, wherein the noise reducing member is configured to pneumatically damp the solenoid.

7. The elevator system of claim 6, wherein the noise reducing member comprises a seal that is received against the armature within the solenoid.

8. A device for use in an elevator system, comprising:

at least one friction member that is selectively moveable into a damping position in which the friction member engages at least one guide rail to damp movement of an elevator car associated with the device;

a solenoid actuator having an armature that is situated for vertical movement, the armature moving upward when the solenoid is energized to move the friction member into the damping position, a mass of the armature urging the armature in a downward vertical direction when the solenoid is not energized, causing the friction member to move out of the damping position.

9. The device of claim 8, wherein the vertical movement of the armature is translated into horizontal movement of the friction member.

10. The device of claim 9, comprising an arm that supports the friction member near one end of the arm; and a linkage coupling the armature to the arm, a mass of the linkage urging the armature downward when the solenoid is not energized.

11. The device of claim 8, comprising two friction members that move toward each other when moving into the damping position.

12. The device of claim 8, wherein the solenoid comprises a noise reducing member that reduces noise associated with movement of the armature.

13. The device of claim 12, wherein the noise reducing member is configured to pneumatically damp the solenoid.

14. The device of claim 13, wherein the noise reducing member comprises a seal that is received against the armature within the solenoid.

15. A method of controlling a position of an elevator car, comprising the steps of:

stopping the elevator car in a desired position;

energizing a solenoid to cause upward movement of an armature of the solenoid to thereby cause a friction member to move into a damping position in which the friction member engages a guide rail associated with the elevator car; and deenergizing the solenoid such that the armature is urged downward by force of gravity, which in turn moves the friction member out of the damping position, before moving the elevator car.

16. The method of claim 15, comprising causing the friction member to move horizontally responsive to vertical movement of the armature.

17. The method of claim 15, comprising supporting the friction member on an arm;

associating a linkage with the armature to couple the armature to the arm; and allowing the mass of the linkage to urge the armature downward when the solenoid is deenergized.

18. The method of claim 15, comprising reducing noise associated with movement of the armature.

19. The method of claim 18, wherein the step of reducing noise comprises pneumatically damping movement of the armature within the solenoid.

* * * * *